US007699439B2

(12) United States Patent
Nishimura et al.

(10) Patent No.: US 7,699,439 B2
(45) Date of Patent: Apr. 20, 2010

(54) DROPLET EJECTION HEAD AND DROPLET EJECTION APPARATUS

(75) Inventors: Yuji Nishimura, Kanagawa (JP); Shinji Seto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 696 days.

(21) Appl. No.: 11/497,381

(22) Filed: Aug. 2, 2006

(65) Prior Publication Data

US 2007/0211118 A1 Sep. 13, 2007

(30) Foreign Application Priority Data

Mar. 8, 2006 (JP) ..... 2006-063138

(51) Int. Cl.
*B41J 2/14* (2006.01)
*B41J 2/045* (2006.01)

(52) U.S. Cl. ..... 347/50; 347/71

(58) Field of Classification Search ..... 347/50, 347/58, 68–72

See application file for complete search history.

(56) References Cited

U.S. PATENT DOCUMENTS 6,637,870 B2 * 10/2003 Sakamoto et al. ..... 347/71
2004/0141028 A1 * 7/2004 Nakamura ..... 347/50

FOREIGN PATENT DOCUMENTS

JP A-11-10875 1/1999

* cited by examiner

*Primary Examiner*—Stephen D Meier
*Assistant Examiner*—Geoffrey Mruk
(74) *Attorney, Agent, or Firm*—Oliff & Berridge, PLC

(57) ABSTRACT

A droplet ejection head includes: a first laminate having plural nozzles; a second laminate bonded to the first laminate and internally having plural pressure generating chambers communicating with the plurality of nozzles; plural piezoelectric devices having individual electrodes and common electrodes, the plural piezoelectric devices being provided in the second laminate correspondingly to the plural pressure generating chambers, the plural piezoelectric devices changing volumes of the plural pressure generating chambers in accordance with driving signal supplied to the individual electrodes so that fluid reserved in the pressure generating chambers is ejected as droplet from the nozzles; a first wiring board connected to the individual electrodes and supplying the driving signal to the individual electrodes; and a second wiring board connected to the common electrodes in common.

10 Claims, 8 Drawing Sheets

(SECOND EXEMPLARY EMBODIMENT)

(FIRST EXEMPLARY EMBODIMENT)

(FIRST EXEMPLARY EMBODIMENT)

(FIRST EXEMPLARY EMBODIMENT)

(FIRST EXEMPLARY EMBODIMENT)

FIG. 4A1
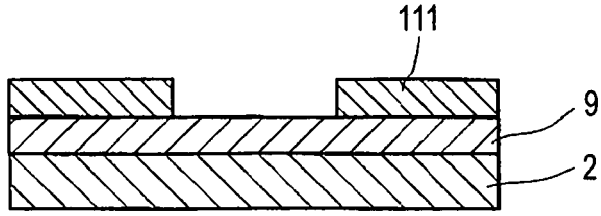
FIG. 4A2
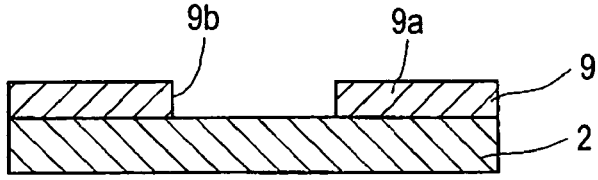
FIG. 4A3
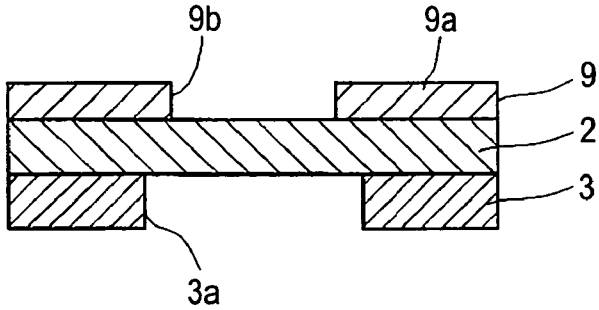
FIG. 4A4
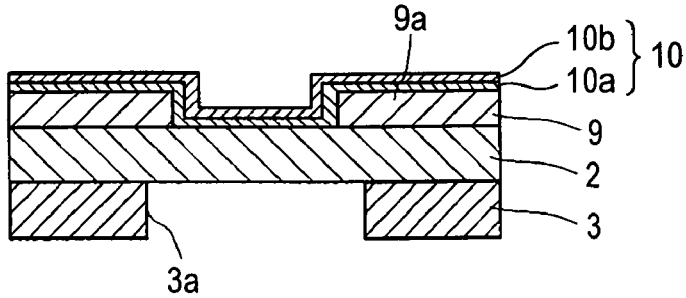
FIG. 4A5
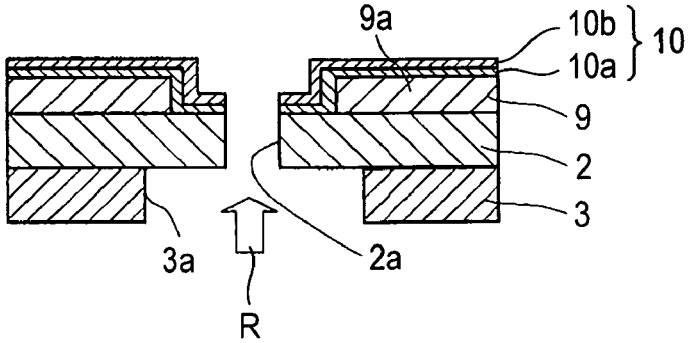

FIG. 4B1
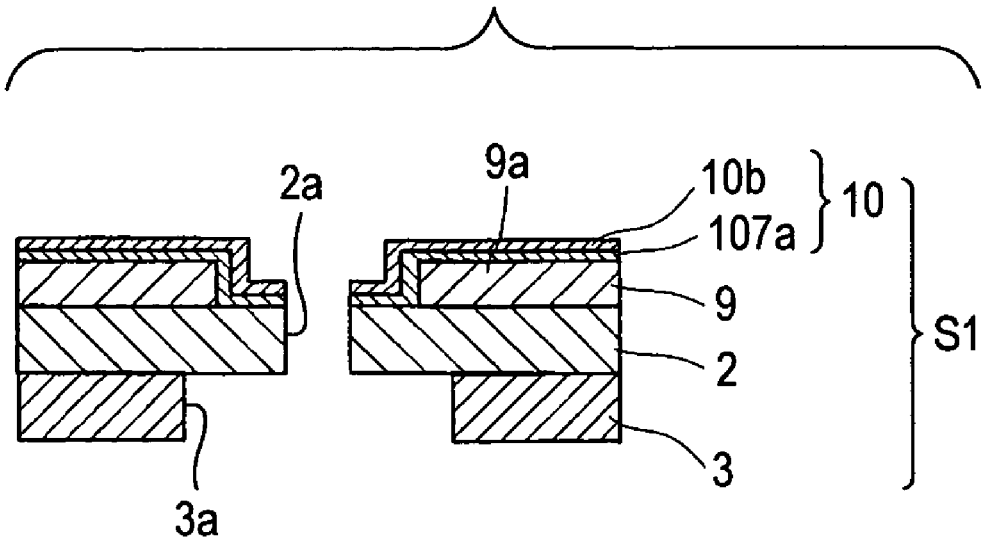
FIG. 4B2
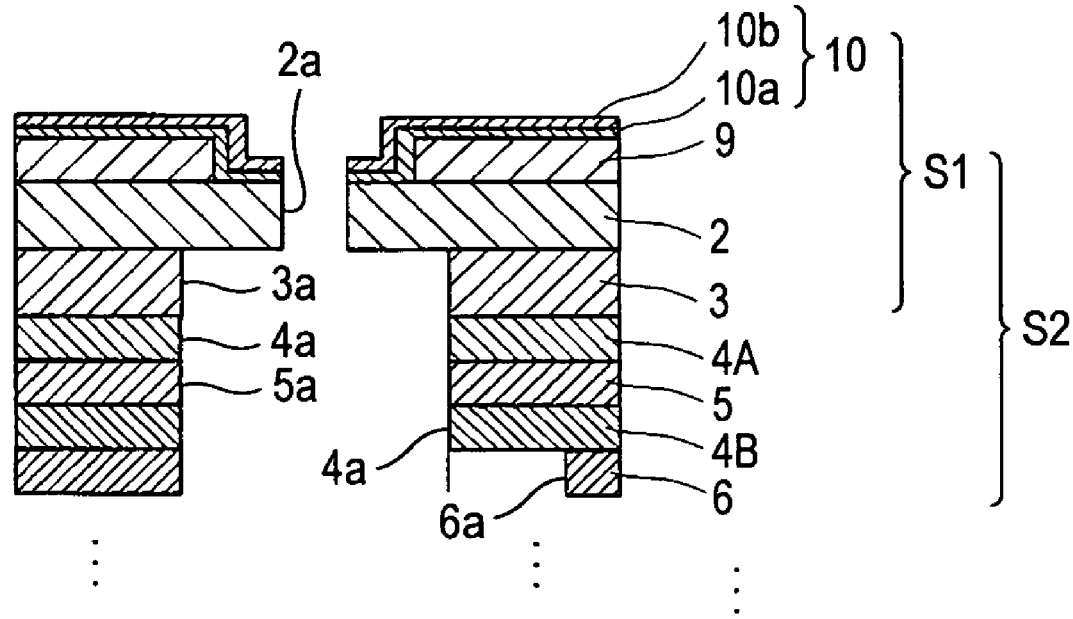

(SEDOND EXEMPLARY EMBODIMENT)

(SECOND EXEMPLARY EMBODIMENT)

(SECOND EXEMPLARY EMBODIMENT)

(SECOND EXEMPLARY EMBODIMENT)

DROPLET EJECTION HEAD AND DROPLET EJECTION APPARATUS

BACKGROUND

Technical Field

The present invention relates to a droplet ejection head and a droplet ejection apparatus, and particularly relates to a droplet ejection head small in size, low in cost, high in degree of freedom on design, and capable of flexibly dealing with a change of design, and a droplet ejection apparatus having the droplet ejection head.

SUMMARY

According to an aspect of the invention, a droplet ejection head includes: a first laminate having plural nozzles; a second laminate bonded to the first laminate and internally having plural pressure generating chambers communicating with the plural nozzles; plural piezoelectric devices having individual electrodes and common electrodes; a first wiring board connected to the individual electrodes and supplying the driving signal to the individual electrodes; and a second wiring board connected to the common electrodes in common. The piezoelectric devices are provided in the second laminate correspondingly to the plural pressure generating chambers, and changes volumes of the plural pressure generating chambers in accordance with driving signal supplied to the individual electrodes so that fluid reserved in the pressure generating chambers is ejected as droplet from the nozzles.

BRIEF DESCRIPTION OF THE DRAWINGS

Exemplary embodiments of the present invention will be described in detail based on the following figures, wherein:

FIGS. 4A1 to 4A5 are sectional views that schematically illustrate a method for manufacturing the droplet ejection head according to the first embodiment of the invention;

FIGS. 4B1 and 4B2 are sectional views that schematically illustrate the method for manufacturing the droplet ejection head according to the first embodiment of the invention;

FIG. 5 is a configuration view that illustrates head units of a color printer using a droplet ejection apparatus according to a second embodiment of the invention;

FIGS. 7A and 7B illustrate a method for connecting a flexible printed wiring board and a head board, in which FIG. 7A illustrates a perspective view before the connection, and FIG. 7B illustrates a perspective view after the connection through extension portions of a diaphragm.

DETAILED DESCRIPTION

First Embodiment (Configuration of Droplet Ejection Head)

Figure 1:
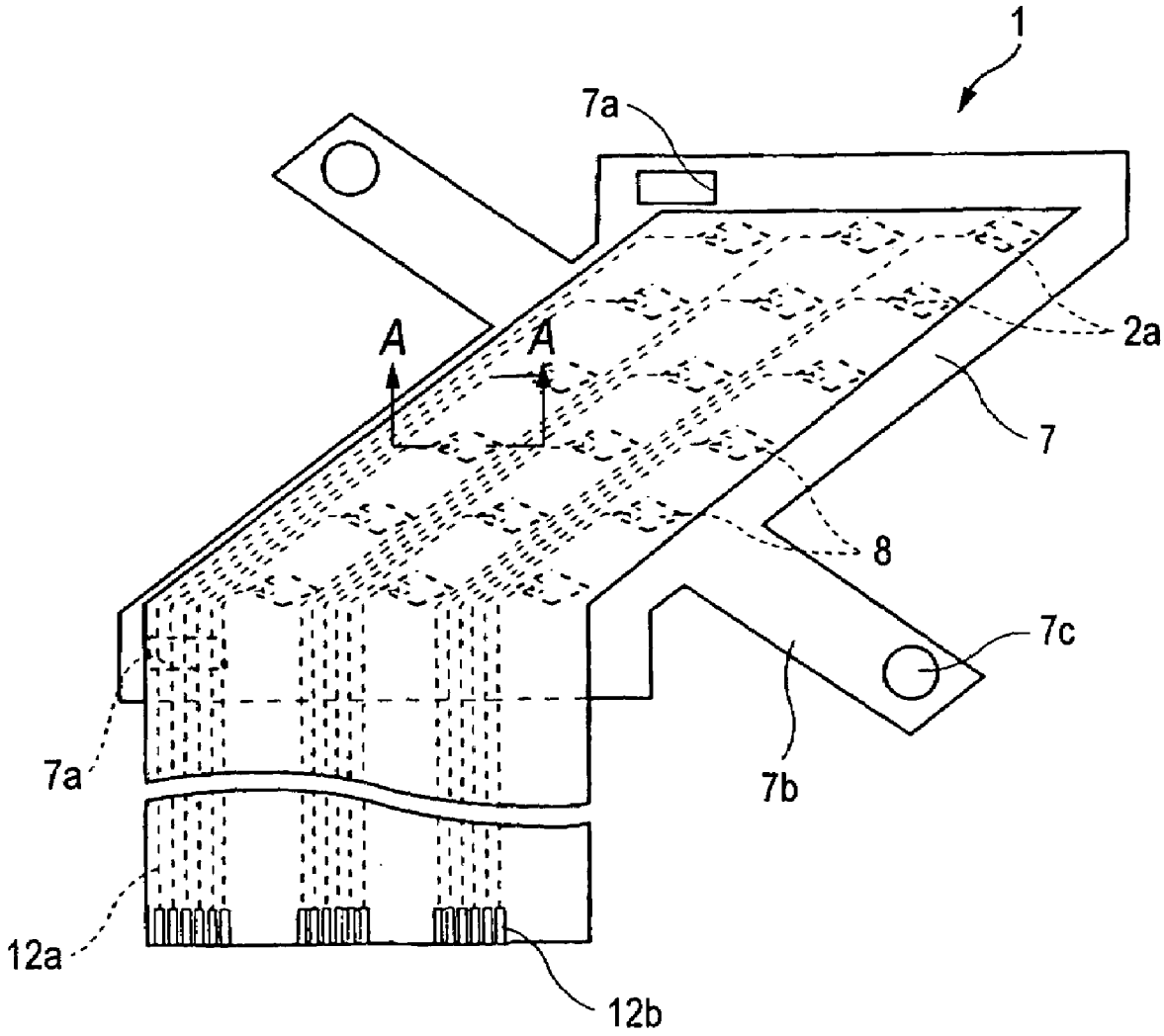
FIG. 1 is a plan view that illustrated a droplet ejection head according to a first embodiment of the invention.
Figure 2A:
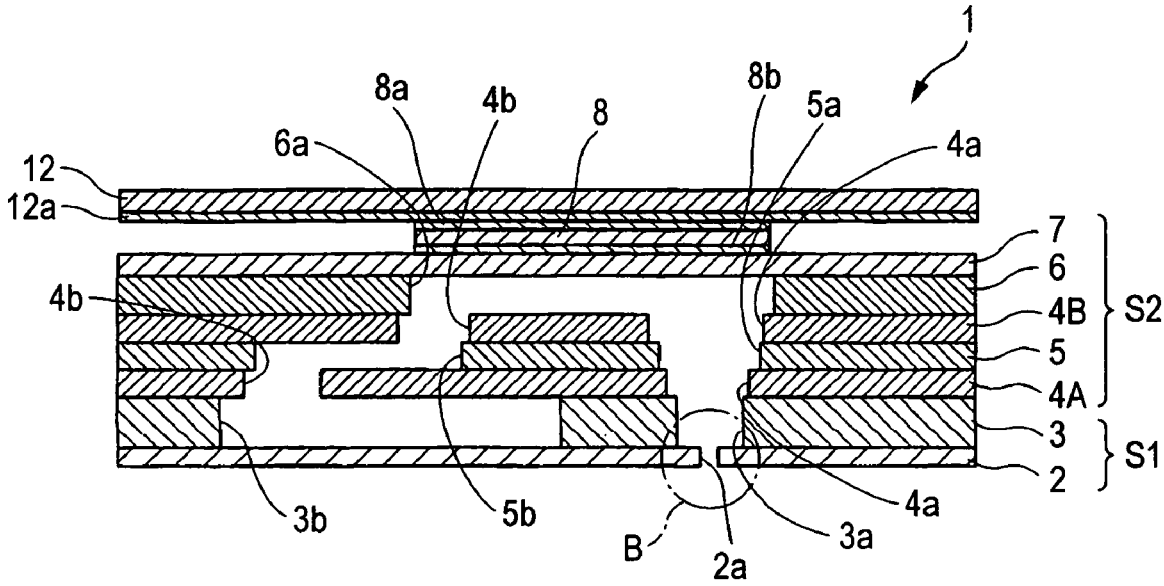
FIG. 2A is a sectional view taken on line A-A in FIG. 1.
Figure 2B:
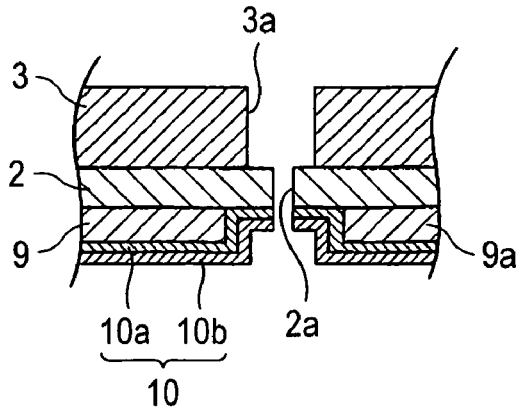
FIG. 2B is a detailed view showing a portion B of FIG. 2A.
Figure 3:
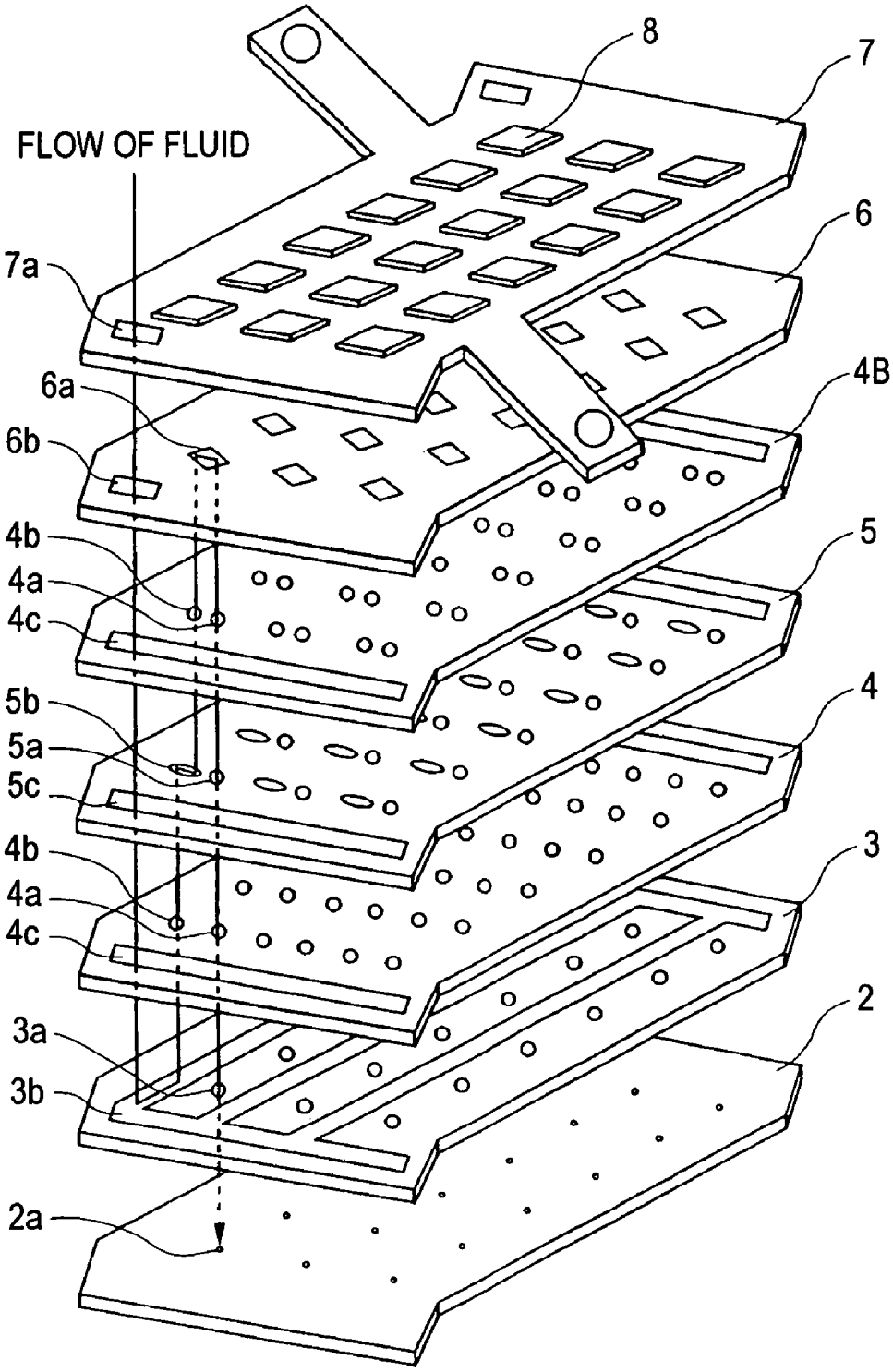
FIG. 3 is an exploded perspective view that illustrated the droplet ejection head illustrated in FIG. 1.

FIGS. 1 to 3 illustrate a droplet ejection head according to a first embodiment of the invention. FIG. 1 is a plan view. FIG. 2A is a sectional view taken on line A-A in FIG. 1, and FIG. 2B is a detailed view of a portion B in FIG. 2A. FIG. 3 is an exploded perspective view of the droplet ejection head. FIG. 3 does not show a flexible printed wiring board which will be described later.

As illustrated in FIG. 1, the droplet ejection head 1 has a substantially parallelogrammatical diaphragm 7, plural piezoelectric devices 8 disposed on the diaphragm 7, and plural nozzles 2*a* formed to be located in opposition to the plural piezoelectric devices 8. A flexible printed wiring board (hereinafter referred to as "FPC") 12 for applying voltages to the piezoelectric devices 8 is provided to cover the plural piezoelectric devices 8. When the piezoelectric devices 8 are driven through the FPC 12, fluid reserved internally is ejected as droplets from the nozzles 2*a*. Although 18 piezoelectric devices 8 are illustrated in FIG. 1, 1,024 piezoelectric devices 8 are disposed actually.

As illustrated in FIG. 2A, the droplet ejection head 1 has a nozzle plate 2 in which the nozzles 2*a* are formed. On the surface (back surface) of the nozzle plate 2 opposite to the ejection side thereof, a pool plate 3 having communication holes 3*a* and fluid pools 3*b*, a first supply hole plate 4A having communication holes 4*a*, supply holes 4*b* and supply channels 4*c* (see FIG. 3), a supply channel plate 5 having communication holes 5*a*, supply channels 5*b* and supply channels 5*c* (see FIG. 3), a second supply hole plate 4B having communication holes 4*a*, supply holes 4*b* and supply channels 4*c* (see FIG. 3), a pressure generating chamber plate 6 having pressure generating chambers 6*a* and supply holes 6*b* (see FIG. 3), the aforementioned diaphragm 7, the aforementioned piezoelectric devices 8 and the aforementioned FPC 12 are laminated in turn.

Further, in the droplet ejection head 1, as illustrated in FIG. 2B, a protrusion portion plate 9 having protrusion portions 9*a* and counter sunk grooves 9*b* is bonded to the ejection-side surface (front surface) of the nozzle plate 2. A water-repellent film 10 composed of a base layer 10*a* and a water-repellent layer 10*b* is formed on the front surface of the periphery of each nozzle 2*a* of the nozzle plate 2 opened in the corresponding counter sunk groove 9*b*, the front surface and flank of the corresponding counter sunk groove 9*b* and the front surface and flank of the corresponding protrusion portion 9*a*. When the water-repellent film 10 is formed around each nozzle 2*a*, a droplet ejected from the nozzle 2*a* can be ejected perpendicularly to the open face of the nozzle 2*a*. Due to the protrusion portion 9*a* and the counter sunk groove 9*b* provided around each nozzle 2*a*, the water-repellent film 10 around the nozzle 2*a* can be protected from mechanical abrasion caused by wiping or the like.

Next, description will be made about the configurations of the respective parts.

(Diaphragm)

As illustrated in FIG. 1, supply holes 7*a* to which fluid is supplied from a not-illustrated fluid tank into the head 1 are formed in the diaphragm 7, and the diaphragm 7 has a pair of extension portions 7*b* extending from the substantially parallelogrammatical portion so as to serve as external lead electrodes. A mounting hole 7*c* is formed in each of the pair of extension portions 7*b*. The diaphragm 7 has conductivity and elasticity. For example, a metal material such as SUS, a composite material of different kinds of metals, a composite material of a metal and a resin, or a surface treated material in which a metal film is formed on the surface of a resin by sputtering or deposition can be used as the diaphragm 7.

(Piezoelectric Device)

Each piezoelectric device 8 is, for example, composed of lead zirconium titanate (PZT) or the like. The piezoelectric device 8 has an individual electrode 8*a* on the upper surface and a common electrode 8*b* on the lower surface. The individual electrode 8*a* and the common electrode 8*b* are formed by sputtering or the like. The common electrode 8*b* on the lower surface is connected to the diaphragm 7 through adhesive, and grounded through the diaphragm 7. The piezoelectric device 8 is also individualized and bonded to a position of the diaphragm 7 corresponding to the corresponding pressure generating chamber 6*a*.

(Flexible Printed Wiring Board)

The FPC 12 has conductive patterns 12*a* connected to the individual electrodes 8*a* of the piezoelectric devices 8 respectively by soldering, and terminals 12*b* provided in terminal portions of the conductive patterns 12*a*.

(Other Configurations)

The nozzle plate 2 is, for example, made of self-welding polyimide resin from the point of view of the ink resistance, the heat resistance, etc. The pool plate 3, the first supply hole plate 4A, the supply channel plate 5, the second supply hole plate 4B and the pressure generating chamber plate 6 are made of metal such as SUS from the point of view of the ink resistance.

(Flow of Fluid)

Description will be made on the flow of the fluid with reference to FIG. 3. The fluid supplied to the supply holes 7*a* of the diaphragm 7 passes through the supply holes 6*b* of the pressure generating chamber plate 6, the supply channels 4*c* of the second supply hole plate 4B, the supply channels 5*c* of the supply channel plate 5, the supply channels 4*c* of the first supply hole plate 4A, the fluid pools 3*b* of the pool plate 3, the supply holes 4*b* of the first supply hole plate 4A, the supply channels 5*b* of the supply channel plate 5, the supply holes 4*b* of the second supply hole plate 4B, the pressure generating chambers 6*a* of the pressure generating chamber plate 6, the communication holes 4*a* of the second supply hole plate 4B, the communication holes 5*a* of the supply channel plate 5, the communication holes 4*a* of the first supply hole plate 4A and the communication holes 3*a* of the pool plate 3. Thus, the fluid is ejected as droplets from the nozzles 2*a* of the nozzle plate 2.

(Method for Manufacturing Droplet Ejection Head)

Description will be made below on a method for manufacturing the droplet ejection head 1 with reference to FIGS. 4A and 4B.

As illustrated in FIG. 4A1, the protrusion portion plate 9 made of SUS is welded with the nozzle plate 2 made of a self-welding polyimide film, by hot pressing.

Next, as illustrated in FIG. 4A2, a patterned resist layer 111 is formed on the protrusion portion plate 9 by a photolithographic method and the protrusion portions 9*a* and the counter sunk grooves 9*b* are formed in the protrusion plate 9 by an etching method.

Next, as illustrated in FIG. 4A3, the pool plate 3 having the communication holes 3*a* and made of SUS is welded with the back surface of the nozzle plate 2 by hot pressing.

Next, as illustrated in FIG. 4A4, an $SiO_2$ film is formed as the base layer 10*a* on the front surface of the nozzle plate 2 and the front surfaces and flanks of the protrusion portions 9*a* by a sputtering method. After that, the water-repellent layer 10*b* made of a fluorochemical water repellent is formed on the base layer 10*a* by a vapor deposition method.

Figure 5:
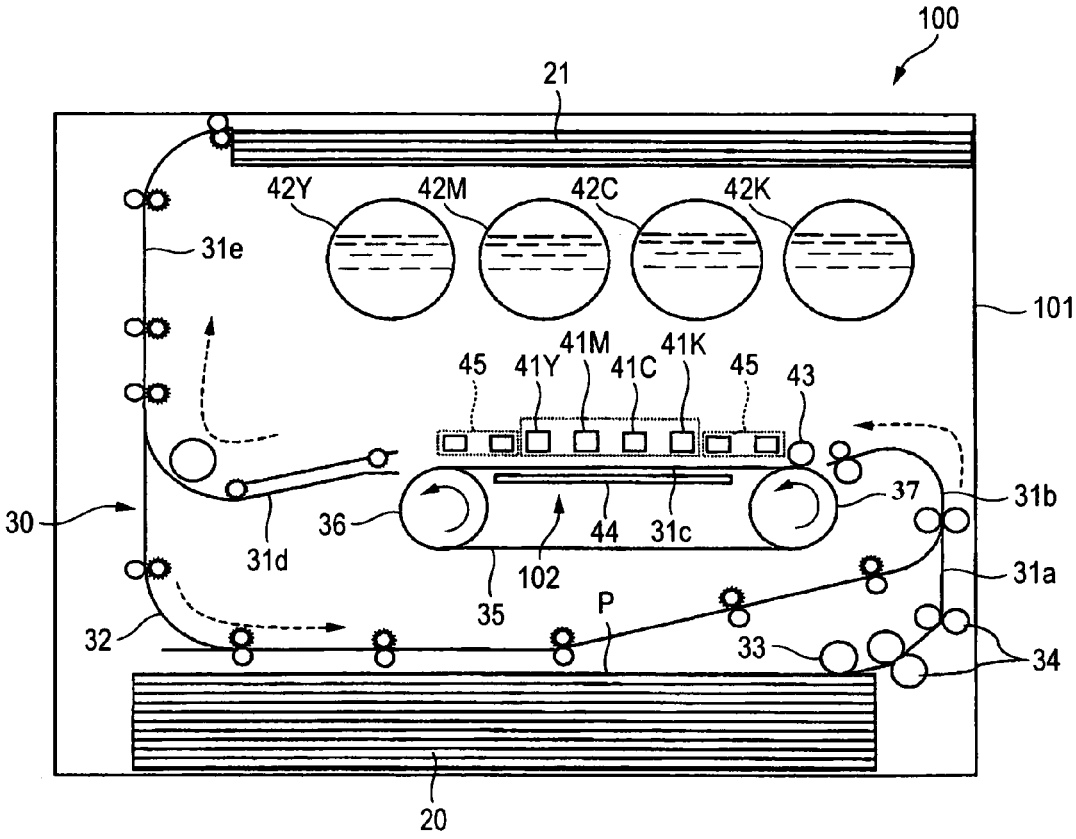

Next, as illustrated in FIG. 4A5, an excimer laser beam is radiated from the pool plate 3 side so as to make through holes. Thus, the nozzles 2*a* are formed.

In this manner, a first laminate S1 is obtained as illustrated in FIG. 4B1.

Next, as illustrated in FIG. 2 and FIG. 4B2, the first supply hole plate 4A, the supply channel plate 5, the second supply hole plate 4B, the pressure generating chamber plate 6 and the diaphragm 7 made of SUS are welded with the first laminate S1 obtained thus, by hot pressing using an adhesive. The hot pressing is performed at a temperature lower than the heat resistance temperature of the water repellent film 10. Thus, a second laminate S2 is obtained.

Next, the piezoelectric devices 8 are bonded to the second laminate S2 through adhesive. Further, the FPC 12 is bonded with the piezoelectric devices 8 by soldering. Thus, the droplet ejection head 1 is obtained.

Second Embodiment (Configuration of Color Printer)

FIG. 5 is a configuration view that illustrates a color printer using a droplet ejection apparatus according to a second embodiment of the present invention. This color printer 100 has a substantially box-like housing 101. A paper feed tray 20 storing paper P is disposed in a lower portion inside the housing 101, and a paper discharge tray 21 to which the recorded paper P will be discharged is disposed in an upper portion inside the housing 101. The housing 101 includes a conveyance mechanism 30 for conveying the paper P along main conveyance paths 31*a*-31*e* and a reverse conveyance path 32. The main conveyance paths 31*a*-31*e* lead from the paper feed tray 20 to the paper discharge tray 21 through a recording position 102. The reverse conveyance path 32 leads from the paper discharge tray 21 side to the recording position 102 side.

In the recording position 102, plural droplet ejection heads 1 illustrated in FIG. 1 are arranged in parallel so as to form four droplet ejection head units. The four droplet ejection head units are arrayed in the conveyance direction of the paper P so as to serve as droplet ejection head units 41 (41Y, 41M, 41C and 41K) for ejecting ink drops of colors of yellow (Y), magenta (M), cyan (C) and black (K) respectively. Thus, a droplet ejection head array is arranged. The detailed layout will be described later.

The color printer 100 has a charging roll 43, a platen 44, maintenance units 45 and a not-illustrated control portion. The charging roll 43 serves as a suction means for sucking the paper P. The platen 44 is disposed to be opposed to the droplet ejection head units 41Y, 41M, 41C and 41K through an endless belt 35. The maintenance units 45 are disposed near the droplet ejection head units 41Y, 41M, 41C and 41K. The control portion controls each part of the color printer 100 and applies a driving voltage to the piezoelectric devices 8 of the droplet ejection heads 1 forming the droplet ejection head units 41Y, 41M, 41C and 41K in accordance with an image signal, so as to eject ink droplets from the nozzles 2*a* and thereby record a color image on the paper P.

Each droplet ejection head unit 41Y, 41M, 41C, 41K has an available printing region not narrower than the width of the paper P. Although a piezoelectric system is used as the method for ejecting droplets, the method is not limited especially. For example, a generally used system such as a thermal system may be used suitably.

Above the droplet ejection head units 41Y, 41M, 41C and 41K, ink tanks 42Y, 42M, 42C and 42K storing inks of colors corresponding to the droplet ejection head units 41Y, 41M, 41C and 41K are disposed respectively. Configuration is made so that the inks are supplied from the ink tanks 42Y, 42M, 42C and 42K to the droplet ejection heads 1 through not-illustrated pipe arrangements respectively.

The inks stored in the ink tanks 42Y, 42M, 42C and 42K are not limited especially. For example, generally used inks such as water-based inks, oil-based inks, solvent-based inks, etc. may be used suitably.

The conveyance mechanism 30 includes a pickup roll 33, plural conveyance rolls 34, the endless belt 35, a driving roll 36, a driven roll 37 and a not-illustrated driving motor. The pickup roll 33 picks up the paper P sheet by sheet from the paper feed tray 20 and supplies the paper P to the main conveyance path 31*a*. The conveyance rolls 34 are disposed in the main conveyance paths 31*a*, 31*b*, 31*d* and 31*e* and the reverse conveyance path 32 respectively. The endless belt 35 is provided in the recording position 102 and for conveying the paper P toward the paper discharge tray 21. The endless belt 35 is stretched between the driving roll 36 and the driven roll 37. The conveyance rolls 34 and the driving roll 36 are driven by the driving motor.

(Droplet Ejection Head Units)

Figure 6:
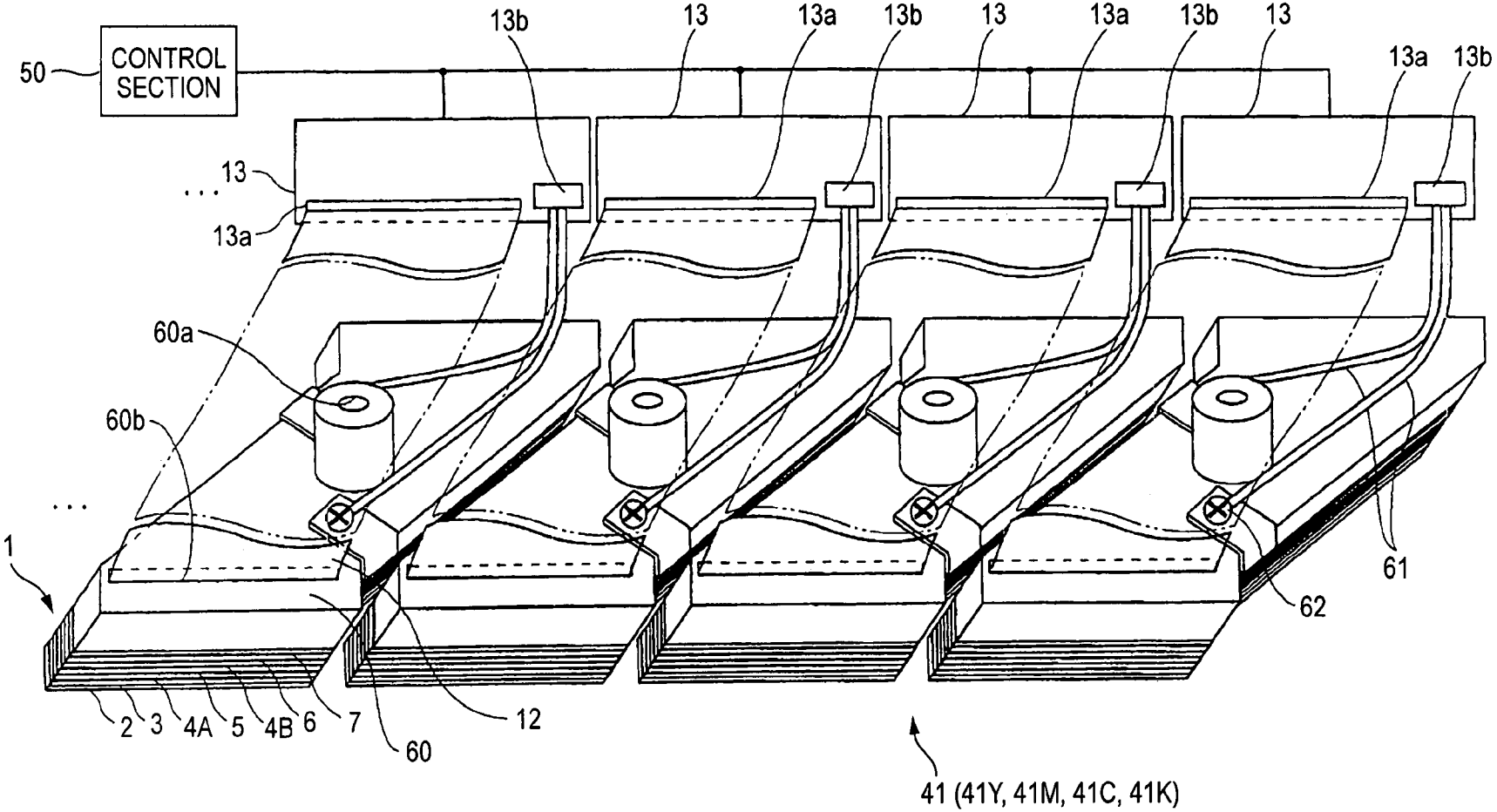
FIG. 6 is a configuration view that illustrates the droplet ejection head units according to the second embodiment of the invention.

FIG. 6 is a configuration view that illustrates the droplet ejection head units. Each droplet ejection head unit 41 (41Y, 41M, 41C, 41K) has a manifold 60 serving as an external joint member for introducing ink into the corresponding droplet ejection head 1 illustrated in FIG. 1. Head boards 13 are provided for the droplet ejection heads 1 respectively. The head boards 13 are connected to a control portion 50 for controlling each part of the color printer 100.

An introduction hole 60*a* for introducing ink, an FPC insertion hole 60*b* for inserting the FPC 12, and threads for attaching the extension portions 7*b* of the diaphragm 7 thereto are formed in each manifold 60. Though not illustrated, a filter for removing foreign matters from ink, a route for supplying the ink from the introduction hole 60*a* to the supply holes 7*a* of the diaphragm 7, etc. are also formed. The manifold 60 is bonded to the droplet ejection head 1 by adhesive or the like.

Each head board 13 has an FPC connector 13*a* and a ground terminal 13*b*. Terminals of the FPC 12 are connected to the FPC connector 13*a*. The ground terminal 13*b* is connected to an earth line. One head board 13 may be shared by the droplet ejection heads 1.

Each extension portion 7*b* of the diaphragm 7 is disposed not to abut against another extension portion 7*b* of another adjacent droplet ejection head 1. Thus, each droplet ejection head 1 is closed as an electric circuit so that the droplet ejection head 1 can be driven individually.

(Electric Connection of Droplet Ejection Head)

Figure 7B:
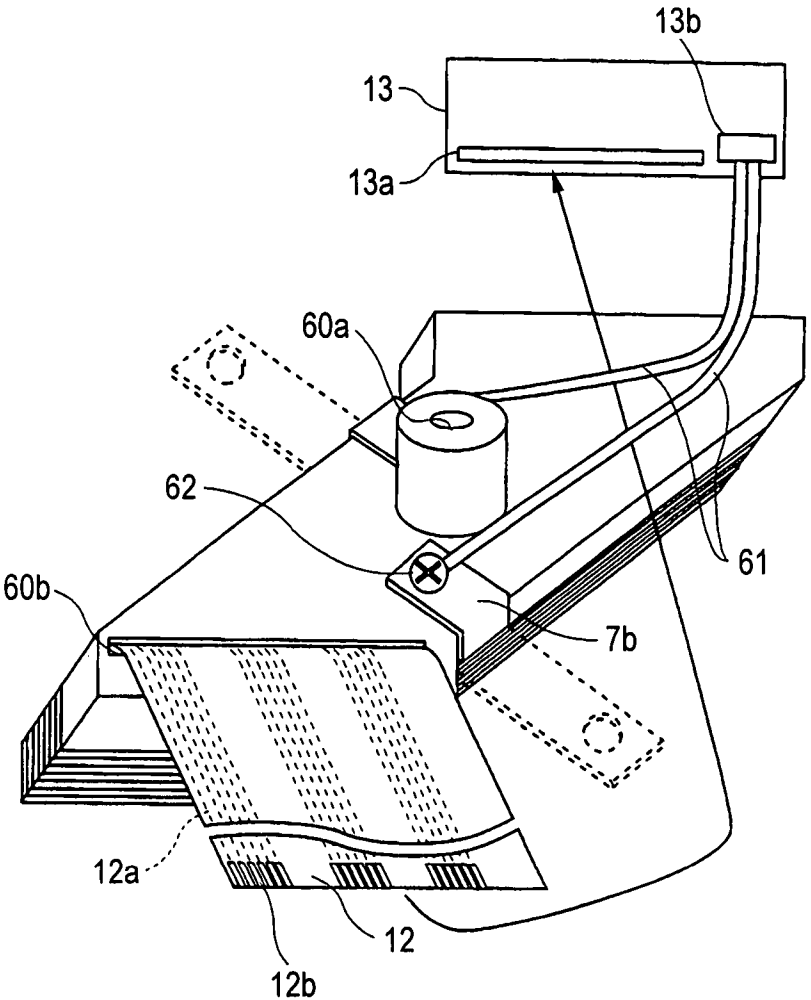
Figure 7A:
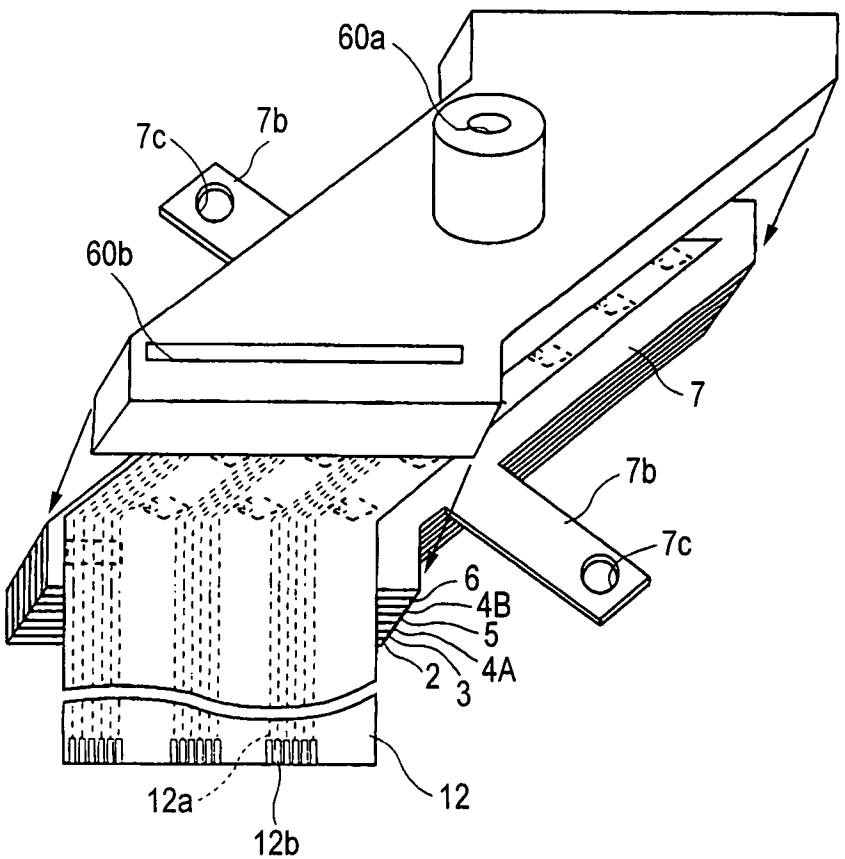

FIGS. 7A and 7B illustrate a method for connecting the FPC 12 and the head board 13. FIG. 7A illustrates a view before the connection, and FIG. 7B illustrates a view after the connection through the extension portions 7*b* of the diaphragm 7.

The FPC 12 is connected to the piezoelectric devices 8. After that, the FPC 12 is led out through the FPC insertion hole 60*b* of the manifold 60 as illustrated in FIG. 7B, and connected to the FPC connector 13*a* of the head board 13 as illustrated in FIG. 6.

The extension portions 7*b* of the diaphragm 7 are bent to the upper surface side of the manifold 60 as illustrated in FIG. 7B. One ends of cables 61 are fixed to the diaphragm 7 through screws 62 respectively, while the other ends of the cables 61 are connected to the ground terminal 13*b* of the head board 13. In this manner, the piezoelectric devices 8 are electrically connected to the head board 13.

(Operation of Color Printer)

Next, the operation of the color printer 100 will be described. Under the control of the control portion, the conveyance mechanism 30 drives the pickup roll 33 and the conveyance rolls 34 so as to pick up the paper P from the paper feed tray 20 and convey the paper P along the main conveyance paths 31*a* and 31*b*. When the paper P approaches the endless belt 35, charges are applied to the paper P due to the electrostatic suction force of the charging roll 43. Thus, the paper P is sucked on the endless belt 35.

The endless belt 35 is driven by the driving roll 36 so as to rotate and move. When the paper P is conveyed to the recording position 102, a color image is recorded on the paper P by the droplet ejection head units 41Y, 41M, 41C and 41K.

That is, the fluid pools 3*b* of the droplet ejection heads 1 illustrated in FIG. 2 are filled with the inks supplied from the ink tanks 42Y, 42M, 42C and 42K respectively. The inks are supplied from the fluid pools 3*b* to the pressure generating chambers 6*a* through the supply holes 4*b* and the supply channels 5*b*. The inks are reserved in the pressure generating chambers 6*a*. When the control portion selectively applies a driving voltage to plural piezoelectric devices 8 in accordance with an image signal, the diaphragm 7 is bent due to the deformation of the piezoelectric devices 8. Thus, the volumes in the pressure generating chambers 6*a* change so that the inks reserved in the pressure generating chambers 6*a* are ejected as ink droplets from the nozzles 2*a* onto the paper P through the communication holes 5*a*, 4*a* and 3*a*, so as to record an image on the paper P. Images of the colors Y, M, C and K are written over one another in turn. Thus, a color image is recorded on the paper P.

The paper P with the color image recorded thereon is discharged to the paper discharge tray 21 through the main conveyance path 31*d* by the conveyance mechanism 30.

When a double-sided recording mode is set, the paper P once discharged to the paper discharge tray 21 returns to the main conveyance path 31*e* again and passes through the reverse conveyance path 32. The paper P is conveyed to the recording position 102 through the main conveyance path 31*b* again. Thus, a color image is recorded on the opposite surface of the paper P to the surface where a color image was recorded previously, by the droplet ejection head units 41Y, 41M, 41C and 41K.

The droplet ejection head and the droplet ejection apparatus according to the present invention are used effectively in various industrial fields where it is requested to eject droplets to thereby form a pattern of high-definition image information, such as an electric/electronic industrial field where ink is ejected onto the surface of a polymer film or a glass to thereby form a color filter for a display by use of an inkjet method or solder paste is ejected onto a substrate to thereby form bumps for mounting parts or to thereby form wiring for a circuit board, a medical field where a reagent is ejected onto a glass substrate or the like to thereby manufacture biochips for testing reaction to samples, etc.

What is claimed is:

1. A droplet ejection head comprising:

a first laminate having a plurality of nozzles;

a second laminate bonded to the first laminate and internally having a plurality of pressure generating chambers communicating with the plurality of nozzles;

a plurality of piezoelectric devices having individual electrodes and common electrodes, the piezoelectric devices being provided in the second laminate correspondingly to the plurality of pressure generating chambers, the plurality of piezoelectric devices changing volumes of the plurality of pressure generating chambers in accordance with driving signal supplied to the individual electrodes so that fluid reserved in the pressure generating chambers is ejected as droplet from the nozzles;

a first wiring board connected to the individual electrodes and supplying the driving signal to the individual electrodes; and a second wiring board connected to the common electrodes in common, wherein the second wiring board includes a diaphragm that is bent in accordance with deformation of the piezoelectric devices so as to change the volumes of the pressure generating chambers, the individual electrodes are provided on first surfaces of the piezoelectric devices respectively, the common electrodes are provided on second surfaces of the piezoelectric devices respectively, the second surfaces being opposite to the first surfaces, the common electrodes are connected to the diaphragm by adhesive, the diaphragm has an extension portion, the common electrodes of the piezoelectric devices are connected to an earth line through the extension portion, the extension portion of the diaphragm is fixedly attached to a first surface of an external bonding member that introduces the fluid into the droplet ejection head, and a second surface of the external bonding member faces the diaphragm.

2. The droplet ejection head according to claim 1, wherein the first wiring board comprises a flexible printed wiring board.

3. The droplet ejection head according to claim 1, wherein the second wiring board comprises a diaphragm bent in accordance with deformation of the piezoelectric devices so as to change the volumes of the pressure generating chambers.

4. The droplet ejection head according to claim 1, wherein the individual electrodes are provided in first surfaces of the piezoelectric devices respectively, and the common electrodes are provided in second surfaces of the piezoelectric devices opposite to the first surfaces respectively.

5. The droplet ejection head according to claim 1, wherein the extension portion of the diaphragm keeps from contacting with an extension portion of another adjacent diaphragm.

6. The droplet ejection head according to claim 1, wherein the second surface of the external bonding member is an opposite surface to the first surface of the external bonding member.

7. The droplet ejection head according to claim 1, wherein the extension portion of the diaphragm is folded at least once to be fixedly attached to the first surface of the external bonding member.

8. A droplet ejection apparatus comprising:

a plurality of droplet ejection heads each having a plurality of piezoelectric devices driven to eject fluid as droplet from a plurality of nozzles toward a droplet-landing surface, each of the droplet ejection heads comprising:

a first laminate having the plurality of nozzles;

a second laminate bonded to the first laminate and internally having a plurality of pressure generating chambers communicating with the plurality of nozzles respectively;

a plurality of piezoelectric devices having individual electrodes and common electrodes, the plurality of piezoelectric devices being provided in the second laminate correspondingly to the plurality of pressure generating chambers, the plurality of piezoelectric devices changing volumes of the pressure generating chambers in accordance with driving signal supplied to the individual electrodes so that fluid reserved in the pressure generating chambers is ejected as droplet from the nozzles;

a first wiring board connected to the individual electrodes and supplying the driving signal to the individual electrodes; and a second wiring board connected to the common electrodes in common, wherein the second wiring board includes a diaphragm that is bent in accordance with deformation of the piezoelectric devices so as to change the volumes of the pressure generating chambers, the individual electrodes are provided on first surfaces of the piezoelectric devices respectively, the common electrodes are provided on second surfaces of the piezoelectric devices respectively, the second surfaces being opposite to the first surfaces, the common electrodes are connected to the diaphragm by adhesive, the diaphragm has an extension portion, the common electrodes of the piezoelectric devices are connected to an earth line through the extension portion, the extension portion of the diaphragm is fixedly attached to a first surface of an external bonding member that introduces the fluid into the droplet ejection head, and a second surface of the external bonding member faces the diaphragm.

9. The droplet ejection head according to claim 8, wherein the second surface of the external bonding member is an opposite surface to the first surface of the external bonding member.

10. The droplet ejection head according to claim 8, wherein the extension portion of the diaphragm is folded at least once to be fixedly attached to the first surface of the external bonding member.

* * * * *